United States Patent [19]

Loqvist et al.

[11] 4,227,986

[45] Oct. 14, 1980

[54] APPARATUS FOR PROVIDING A SURFACE COATING ON THE WALL IN A CAVITY BY MEANS OF ELECTROLYTIC PLATING

[75] Inventors: Kaj-Ragnar Loqvist, Fagersta; Leif-Åke Bennstedt, Falun, both of Sweden

[73] Assignee: Wave Energy Development I Vastmanland Aktiebolag, Fagersta, Sweden

[21] Appl. No.: 917,485

[22] Filed: Jun. 21, 1978

Related U.S. Application Data

[62] Division of Ser. No. 873,524, Jan. 30, 1978.

[30] Foreign Application Priority Data

Feb. 8, 1977 [SE] Sweden ..... 7701371

[51] Int. Cl.[2] ..... C25D 17/12; C25D 17/10

[52] U.S. Cl. ..... 204/209; 204/224 R; 204/272; 204/290 R; 204/DIG. 10

[58] Field of Search ..... 204/224 R, 272, 273, 204/206, 26, DIG. 10, 209, 290 R

[56] References Cited

U.S. PATENT DOCUMENTS

| | | | |
|---|---|---|---|
| 1,927,162 | 9/1933 | Fiedler et al. | 204/26 |
| 1,953,955 | 4/1934 | Crouch | 204/224 R |
| 2,425,359 | 8/1947 | Zavarella | 204/26 X |
| 2,764,540 | 9/1956 | Farin et al. | 204/272 X |
| 3,804,725 | 4/1974 | Haynes | 204/26 |

FOREIGN PATENT DOCUMENTS

| | | | |
|---|---|---|---|
| 43-6848 | 3/1968 | Japan | 204/26 |

*Primary Examiner*—John H. Mack
*Assistant Examiner*—D. R. Valentine
*Attorney, Agent, or Firm*—Larson, Taylor and Hinds

[57] ABSTRACT

A method and apparatus for providing a surface coating of a metal or metal alloy on the wall of an elongate cavity in a workpiece by means of electrolytic plating, the workpiece being used as cathode. An electrolyte containing ions of the metal intended for the coating is brought into movement inside the cavity with the aid of a conveyor, which consists of a resilient and electrically insulating material such as a perforated, net-like or fibrous strip, and which is wound helically round the anode. The strip is fringed or slit on the edge facing towards the cavity wall to form outstanding resilient fingers which are in contact with the cavity wall.

6 Claims, 3 Drawing Figures

APPARATUS FOR PROVIDING A SURFACE COATING ON THE WALL IN A CAVITY BY MEANS OF ELECTROLYTIC PLATING

This is a division, of application Ser. No. 873,524 filed Jan. 30, 1978.

The present invention relates to a method and apparatus for providing a surface coating of a metal or a metal alloy on the wall of a cavity in a workpiece of metal or metal alloy, e.g. on the wall in the flushing channel of a rock drilling rod, on the inner wall of an encapsulating tube for nuclear fuel rods or on the inner wall in pipes or details with small or large diameter. The invention also relates to a hollow product in which the cavity wall is provided with such a coating.

A conventional method of providing metallic surface coating in cavities is to thermically spray metal in the form of powder in the cavity, the powder depositing itself on the walls of the cavity. Examples of such thermic spray methods are flame spraying, electric arc spraying and plasma spraying. The drawback with thermically sprayed coatings is that they have poor ashesion to the parent material, are unevenly distributed and are porous in structure.

The present invention has the object of providing a dense and well-adhering surface coating on the inner wall of hollow products such as rock drilling rods, rock drill bits, encapsulating tubes for nuclear fuel rods etc., thereby increasing the fatigue strength and resistance to corrosion of said products or to increase the wear strength or lessen the frictional resistance thereof.

According to the invention, this surface coating is provided by electrolytic plating, whereby the electrolyte containing ions of at least one metal intended for coating is brought into movement inside the cavity with the aid of at least one conveyor, which includes a resilient and electrically insulated material, mounted on at least one shaft, e.g. in the form of an elongate anode, and which is brought into contact with and adjusts itself to the wall of the cavity and is caused to move relative to the wall of the cavity, rapid and continuous electrolyte and/or gas conveyance thus being obtained, while a comparatively low electrolyte temperature is maintained. Suitably, at least one strip, helically wound in the longtudinal direction around the anode, is used as the electrically insulating and conveying material, and this strip is stiff, flexible and preferably perforated and/or fibous, and can also be fringed.

In relation to surface coatings obtained with previously known electrolytic coating methods, the surface coating produced according to the invention gives inter alia better corrosion protection and improved fatigue strength. The prevailing inventive idea in the method according to the invention is the use of a new type of resilient performate fibrous and electrically non-conducting material, which functions as a conveyor of electrolyte and gases formed during the process, is preferably mounted on the anode and movable in relation to the workpiece forming the cathode. The invention is especially favourable for selectively plating passages with a length of several meters and varying cross sectional area along the extension of the passage, for example. With known methods, such plating would result in unrealistically long plating times, and conventional methods are practically unusable for plating passages with small diameters, such as the flushing channel in rock drilling rods. In coating, for example, encapsulating tubes for nuclear fuel by means of the method according to the invention, a dense coating is obtained which counteracts any tendency of the parent material to become brittle, thereby preventing leakage of dangerous radioactive gases. Similarly, the coating according to the invention counteracts the risk of cracking coming from tensional stresses arising through temperature variations in the nuclear fuel rods.

Very small quantities of electrolyte are required according to the invention, which is advantageous inter alia with regard to the environment. Furthermore, the electrolyte is not bound to the electrolyte carrying material, i.e. it is not collected in pockets to become stationay there, as is the case in plating with wadding as electrolyte carrier, for example. The invention enables the flow rate of electrolyte to be heavily increased so that good cooling is obtained, and thus the coating rate can be increased considerably in comparison with known methods. In comparison with bath plating, which furthermore gives a poor surface coating because of hydrogen brittleness, the coating rate can be increased about 70 times, for example.

The plating method according to the invention is similar to known plating methods such as bath plating and brush plating in the respect that electrolyte and electric current ate usilized in all these methods. In bath plating, the object to be plated is placed in an electrolytic bath, and electric current causes the metallic deposition. In brush plating, the electrolytic bath consists of small drops in a long-fibrous, soft, electrically non-conducting material such as wadding or cotton wool, placed around the anode which usually consists of graphite. When the electrolyte in the material has given off its metal content, new electrolyte is added, and thanks to a certain movement taking place between the anode and the object to be plated, i.e. the cathode, the plating speed will be greater than in bath plating. The method according to the invention distinguishes from brush plating in the respect that not only cathode and anode move in relation to each other but the electrolyte also comes into vigorous movement with relation to the anode and cathode, by reason of the completely new electrolyte and gas conveying apparatus according to the invention. The advantages which are gained hereby are inter alia heavy cooling because of high electrolyte throughout, allowing high current density and thereby a higher metal deposition rate than in conventional methods. The metal coatings will be very dense and uniform, which increases the strength of the coating. Contrary to known methods, the method according to the invention can also be used for coating curved passages with diameters down to some millimeters and with lengths of several meters. The passages can furthermore have varying cross sectional area and can either be bottoming or throughpassages.

The invention will now be described in detail in the following while referring to the attached drawing figures, on which an apparatus according to the invention is schematically illustrated by way of example.

Similar parts have been given the same reference numerals in the different figures.

Figure 1:
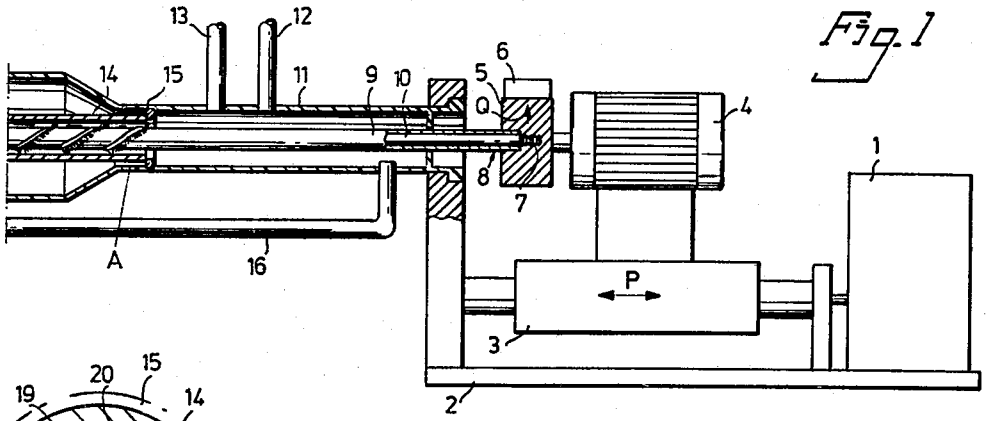
FIG. 1 shows schematically and partly in section an apparatus according to the invention, together with the object which is to be treated by the method according to the invention.

The apparatus shown in FIG. 1 comprises an electric motor 1, mounted on a bed 2 and coupled to a connecting rod on a carriage 3 via a (not shown) excenter, the carriage thus executing a reciprocating movement as indicated by the arrow P. A motor 4 is arranged above the cariage 3 and accompanies the reciprocatory motion of the carriage, its rotating power take-off shaft driving a current—carrying copper collector 5 to rotate in the direction of the arrow Q. An electric current is supplied to the collector 5 via a carbon brush 6, the current having a strength giving a current density of 0.1–3.0 $A/cm^2$, for example. The collector is provided with means 7 for screwing fast the anode 8, which consists of an outer pipe 9 of stainless steel and an inner core 10 of copper. The anode casing consists of stainless steel so that the anode is not corroded by the electrolyte, while the core consists of copper so that the anode will have good electrical conductivity. The anode is mounted inside a plastic tube 11, to which is supplied electrolyte by means of a pump via the opening 12, and flushing water via the opening 13. The object or workpiece 14, the cavity of which is to be plated, is fixedly clamped inside the tube 11 by means of a packing 15. To control the amount of electrolyte in the tube 11 there is an overflow pipe 16. To obtain sufficient electrolyte transport in the cavity, the apparatus is suitably inclined so that the openings 12, 13 assume a heightened position.

Figure 2:
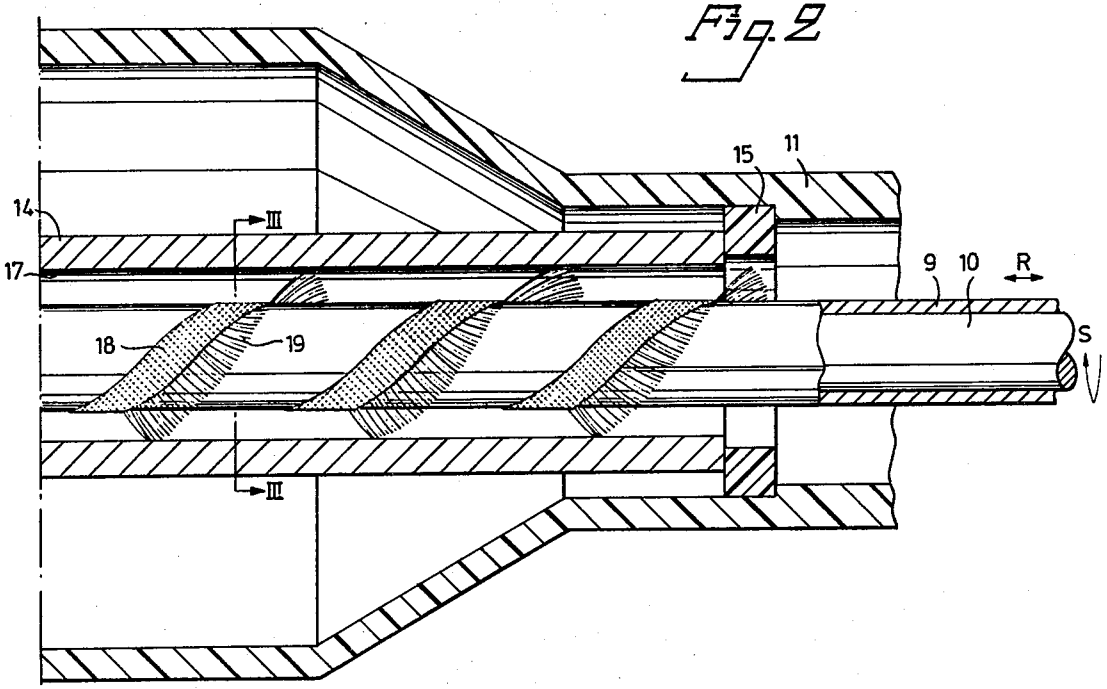
FIG. 2 shows to a larger scale a section of the portion A in FIG. 1.

The section A according to FIG. 1 is shown in FIG. 2 to a much enlarged scale, the wall of the passage to be plated in the workpiece 14 being denoted by the numeral 17. A fringed stiff strip 18, of plastic material for example, is helically wound round the anode 8 and anchored to it, the fringes 19 of the strip being in contact with the passage wall 17. As is indicated by the arrows R, S and as has already been explained in conjunction with FIG. 1, the anode 8 and the strip 18 execute a combined oscillating motion R and rotating motion S inside the cavity 17. By means of the helical arrangement of the strip 18, foam and gases formed during plating with the high current density used in the invention are conveyed out of the cavity. To further increase the rate at which electrolyte, foam and gases are transported, the workpiece with anode and strip can be arranged vertically, or be given a suitable inclination adjusted to accommodate the object being treated.

Figure 3:
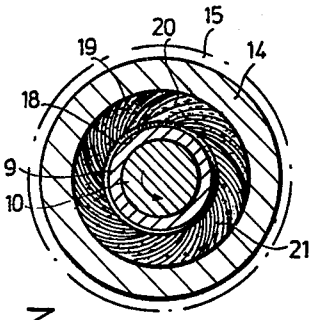
FIG. 3 shows a section along the line III—III in FIG. 2.

It is apparent from the section shown in FIG. 3 how the electrolyte 20 is transported by means of the strip 18. The foam or gas 21 generated during plating also accompanies this transport. It has been previously stated that the anode has a casing of stainless steel and a core of copper, which is especially suitable for an alkaline electrolyte. When a copper coating is to be deposited, the anode can consist purely of copper, the anode being consumed continuously as coating is carried out. When an acidic electrolyte is used, the anode casing should consist of platinum which is suitably plated on a copper core to obtain good electrical conductivity.

The anode can be in the form of a string, rope, wire or a tube of metal or metal alloy, but can also consist of graphite, especially for plating short passages. If, for example, an anode in the form of a rope on which there is mounted the strip 18 is used, even passages having varying cross sectional area in the longitudinal direction of the passage, and which are also curved, can be plated by the fringes 19 of the strip being always brought into contact with the wall of the passage 17, and thus scraping it. The space in the cavity which is not taken up by the anode and strip are filled with electrolyte round the strip during the process, while the rest of the space is taken up by the gases generated during plating. A plating current can thereby pass unhindered from the anode via the electrolyte to the cathode, i.e. the workpiece, where the metal deposit takes place, simultaneously as the generated gases have plenty of room to expand.

An apparatus in which the anode together with the plastic strip 18 rotates and oscillates in relation to the workpiece has been described in detail hereinbefore. It is naturally also possible to make the apparatus so that the workpiece, i.e. the cathode, rotates and/or oscillates in relation to the electrolyte and gas conveying material instead, where the anode can be excentrically placed in the cavity of the workpiece. Similarly, the electrolyte and gas conveying material can naturally consist of other types of perforated, fibrous or net-like bands than the plastic strip mentioned in the preceding. The function of the resilient and electrically insulating material as a conveyor of electrolyte, foam and gases can be supplemented by forming the anode as a screw conveyor, and several conveyors can furthermore be arranged in the cavity. The resilient and insulating material can thereby be formed with more regard to its scraping or polishing function. Especially in the plating of bottoming holes, the anode can be made in such a way for this purpose that gases and/or electrolyte can be conveyed through an axial passage in the anode.

What we claim is:

1. An apparatus for providing a surface coating of a metal or metal alloy on the wall of an elongate cavity workpiece by means of electrolytic plating, the workpiece being used as a cathode, characterized by at least one anode for placement longitudinally extending in the cavity of a workpiece, and at least one conveyor, comprising a resilient and electrically insulating material for transporting the electrolyte and gas produced during said plating, said material comprising at least one flexible, homogeneous, perforated, net-like or fibrous strip helically wound around the anode in its longitudinal direction, said helically wound strip having outstanding resilient fingers in contact with the wall of said cavity while the strip lies against the anode and being enabled to come into contact with every part of said surface while adjusting to the surface to be coated.

2. Apparatus as claimed in claim 1, characterized in that the anode consists of an elongate means, movable in the cavity of the workpiece, preferably in the form of a red wire, tube or rope of metal on which the resilient and electrically insulating material transporting the electrolyte and gas is arranged.

3. Apparatus as claimed in claim 1, characterized in that the anode consists of stainless steel.

4. Apparatus as claimed in claim 1, characterized in that the anode has an internal core of a material with good electrical conductivity, e.g. copper.

5. Apparatus as claimed in claim 1, characterized in that the anode has a covering of metal on a copper core.

6. Apparatus as claimed in claim 1, characterized in that the anode has the form of a screw conveyor.

* * * * *